US009839093B1

(12) United States Patent
Blanchard et al.

(10) Patent No.: US 9,839,093 B1
(45) Date of Patent: Dec. 5, 2017

(54) SELF-HEALING OVERTEMP CIRCUITS IN LED LIGHTING SYSTEMS

(71) Applicant: Musco Corporation, Oskaloosa, IA (US)

(72) Inventors: David L. Blanchard, Oskaloosa, IA (US); Andrew J. Schembs, Johnston, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 15/205,742

(22) Filed: Jul. 8, 2016

Related U.S. Application Data

(60) Provisional application No. 62/190,941, filed on Jul. 10, 2015.

(51) Int. Cl.

| | |
|---|---|
| ***H05B 39/10*** | (2006.01) |
| ***H05B 33/08*** | (2006.01) |
| ***H05B 37/02*** | (2006.01) |
| ***F21V 29/50*** | (2015.01) |

(Continued)

(52) U.S. Cl.
CPC ..... *H05B 33/0884* (2013.01); *F21V 23/003* (2013.01); *F21V 29/50* (2015.01); *H05B 33/083* (2013.01); *H05B 33/0815* (2013.01); *H05B 33/0854* (2013.01); *H05B 37/0227* (2013.01); *H05B 37/0272* (2013.01); *F21Y 2115/10* (2016.08)

(58) Field of Classification Search
CPC ..... H05B 33/0815; H05B 33/0818; H05B 41/2828; H05B 41/3921; H05B 41/3927; H05B 41/46; H03F 1/548; H02H 7/127; B23K 11/248; F02P 17/12; H01J 61/52; H01J 65/044; H01J 61/523; F21K 9/00; F21V 29/004
See application file for complete search history.

(56) References Cited

U.S. PATENT DOCUMENTS

| | | | |
|---|---|---|---|
| 7,209,958 | B2 | 4/2007 | Crookham et al. |
| 8,651,704 | B1 | 2/2014 | Gordin et al. |
| 8,789,967 | B2 | 7/2014 | Gordin et al. |

(Continued)

OTHER PUBLICATIONS

Musco Corporation, "Provisional Patent Application" filed Jul. 10, 2015, U.S. Appl. No. 62/190,941 "Self-Healing Overtemp Circuits in LED Lighting Systems", 101 pages.

(Continued)

*Primary Examiner* — Minh D A
(74) *Attorney, Agent, or Firm* — McKee, Voorhees & Sease, PLC

(57) ABSTRACT

A self-healing overtemp circuit is described and illustrated comprising a temperature sensing circuit, a voltage sensing circuit, and optionally, a current sensing circuit. The self-healing overtemp circuit is designed to ramp down power in an LED lighting system (or other electrical circuit) in response to a sensed or impending thermal runaway (and optionally, overcurrent) event. Said thermal runaway and overcurrent events may be a result of failure of one or more components (e.g., driver, active cooling means) of the lighting system. The self-healing overtemp circuit further comprises means of restoring power to said LEDs in a manner that avoids (i) a perceivably bright flash of light or (ii) increased risk of component failure.

16 Claims, 10 Drawing Sheets

(51) Int. Cl.
*F21V 23/00* (2015.01)
*F21Y 115/10* (2016.01)

(56) References Cited

U.S. PATENT DOCUMENTS

| | | | | |
|---|---|---|---|---|
| 8,946,991 | B2 | 2/2015 | Gordin | |
| 9,028,115 | B1 | 5/2015 | Gordin | |
| 2011/0254554 | A1* | 10/2011 | Harbers | H05B 33/0893 324/414 |
| 2014/0217887 | A1* | 8/2014 | Knoedgen | H05B 33/0815 315/51 |
| 2015/0108904 | A1* | 4/2015 | Chen | H03K 17/133 315/153 |

OTHER PUBLICATIONS

Musco Corporation, "Non-Provisional Patent Application" filed Jul. 8, 2016, U.S. Appl. No. 15/205,948 "Low Current LED Fixture Internal Auxiliary Power Supply", 15 pages.
Musco Corporation, "Provisional Patent Application" filed Aug. 22, 2014, U.S. Appl. No. 62/040,741 "Apparatus, Method, and System for Galvanically Isolated Control and Monitoring of LED Drivers" 73 pages.
Musco Corporation, "Provisional Patent Application" filed Feb. 20, 2015, U.S. Appl. No. 62/118,675, "Apparatus, Method, and System for Lighting Fixture Thermal Management" 128 pages.

* cited by examiner

SELF-HEALING OVERTEMP CIRCUITS IN LED LIGHTING SYSTEMS

CROSS-REFERENCE TO RELATED APPLICATIONS

This application claims priority under 35 U.S.C. §119 to provisional U.S. application Ser. No. 62/190,941, filed Jul. 10, 2015, which is hereby incorporated by reference in its entirety.

I. BACKGROUND OF THE INVENTION

The present invention generally relates to what will be referred to herein as "overtemp circuits"; namely, circuits included in electrical designs which remove or reduce power supplied to one or more components when a temperature (e.g., junction temperature, ambient temperature) exceeds a threshold. More specifically, the present invention relates to overtemp circuits in LED lighting systems, and apparatus, means, and methods for preventing or mitigating undesirable lighting effects that occur after the temperature threshold issue is resolved and power is returned to the one or more components of the lighting system.

It is well known that in recent years the reduction in cost and increase in luminous efficacy (lm/W) of LEDs has permitted their use beyond novelty and general purpose lighting and into areas of more specialized lighting. For specialized lighting applications such as wide area or sports lighting, often a large number of LEDs (e.g., many hundreds for a single tennis court) are required to provide uniform lighting that meets minimum requirements—see, e.g., Illuminating Engineering Society (IES) RP-06-01 *Recommended Practice for Sports and Recreational Area Lighting* for examples of such lighting requirements. As is also well known in the art, high luminous efficacy—a primary selling point of LEDs—is only realized if LED junction temperature is kept low. Thus, it stands to reason that using many hundreds (if not thousands) of LEDs so to adequately light a sports field to one or more standards (as dictated by governing bodies, municipalities, or otherwise) cannot be done in a cost-effective manner unless measures are taken to control the temperature of said LEDs.

In the art of LED wide area or sports lighting there currently exist two approaches to controlling junction temperature: passive and active cooling. Passive cooling techniques are generally defined as means which do not require external forces or, to some extent, moving parts. An external fixture housing which is designed to promote airflow, formed from thermally conductive material, and includes a number of heat fins to increase surface area is an example of a passive cooling technique in LED lighting design; another is the inclusion of heat pipes or thermosyphons such as is discussed in U.S. Provisional Patent Application Ser. No. 62/118,675 incorporated by reference herein in its entirety. Active cooling techniques in the current art of LED lighting design typically center around forced air or fluid in, through, around, or generally proximate heat sources (e.g., LEDs); some examples are described in U.S. Pat. Nos. 8,651,704 and 9,028,115 which are incorporated by reference herein in their entirety. It is generally understood that active cooling techniques are more aggressive and remove or redistribute heat from an LED lighting system more effectively than passive cooling techniques.

If passive or active cooling techniques fail (e.g., power to a fan is disabled), one would expect the temperature of the LEDs to increase and efficacy to decrease. If said cooling techniques are applied system-wide, the temperature of other components (e.g., drivers) may increase in commensurate fashion upon such a failure. An increase in temperature of an LED lighting system, left unmitigated, could reduce cost effectiveness and damage parts.

It is logical, then, that if such a thermal runaway event occurred—as it will be called herein—a potential solution would be to temporarily terminate power to the LEDs and/or other temperature sensitive components until the situation is resolved and components cool (e.g., via natural convection). One can think of such a solution as similar to GFCI circuits common in other areas of electrical design; a safety feature that only triggers in extreme events. However, for specialty LED lighting applications such as wide area and sports herein lies a problem—the high voltages required for the large number of LEDs prevents implementation of a traditional overtemp circuit. There are no high voltage (e.g., 1000V) solutions to thermistors or bi-metallic switches that would permit detection of a thermal runaway event and act to open a circuit, thereby terminating power to the LEDs. Thermal fuses are terminal event devices—if a thermal fuse opens a circuit to mitigate a thermal runaway event, that fuse must be replaced before power to the LEDs can be restored. Given that wide area and sports lighting applications typically have the aforementioned hundreds (if not a thousand or more) LEDs mounted several dozens of feet in the air in an environmentally sealed housing, replacing thermal fuses in a luminaire (also referred to herein as a fixture) is highly impractical.

The art is at a loss. LEDs operated in large number under high voltage conditions—such as in wide area or sports lighting applications—are prime candidates for passive and active cooling techniques, and failure of said cooling techniques would likely result in thermal runaway thereby also making such lighting applications prime candidates for overtemp circuits. That being said, there are no adequate overtemp circuits commercially available to address high voltage LED lighting systems. Thus, there is room for improvement in the art.

II. SUMMARY OF THE INVENTION

In the current state of the art of LED lighting design it is well known that to make LEDs cost effective as compared to more traditional light sources for wide area and sports lighting (e.g., HID lamps) temperature control is critical. While passive and active cooling techniques exist for LED lighting systems, they are not impervious to failure. In the event of a thermal runaway event, the art may benefit from an overtemp circuit which could temporarily terminate or reduce power to the LEDs until the situation is resolved and/or LED temperature decreases. That being said, there are no adequate high voltage solutions to traditional overtemp circuits (e.g., those which rely upon mechanical means to open a circuit). Further, even if such overtemp circuits existed for LED lighting systems operating around 1000V, there is still the matter of restoring power—either from a reduced power or no power state—after the thermal runaway event has been resolved, and in a manner that mitigates undesirable lighting effects and potential component damage.

It is therefore a principle object, feature, advantage, or aspect of the present invention to improve over the state of the art and/or address problems, issues, or deficiencies in the art.

Envisioned is an overtemp circuit designed for LED lighting systems operating at high voltage, said overtemp circuit self-healing in the sense that once a thermal runaway event has been resolved, the overtemp circuit permits power to the LEDs to be reestablished without replacement of parts or intervention from an operator (for at least some configurations). Said envisioned overtemp circuit further includes apparatus or means for (i) dissipating excess voltage that builds up during the time in which there is no load on the driver, or (ii) cycling a driver to prevent startup at an excessive voltage. In either scenario, excess voltage could result in damage to the LEDs (or other components) when power is reestablished.

Further objects, features, advantages, or aspects of the present invention may include one or more of the following:

a. apparatus, methods, and/or means to detect a thermal runaway event in an LED lighting system;
b. apparatus, methods, and/or means to reduce or terminate power to impacted LEDs and/or other components in response to detecting a thermal runaway event; and
c. apparatus, methods, and/or means to reestablish full or partial power to said LEDs and/or other components when the thermal runaway event has been resolved;
d. said apparatus, methods, and/or means:
   i. robust (i.e., not prone to breakage or fatigue);
   ii. not formed from terminal event devices (i.e., devices such as fuses which are designed to fail and require replacement in accordance with a threshold);
   iii. having multiple options for being supplied with power;
   iv. having multiple options for signal communication;
   v. having an option for overcurrent protection; and
   vi. having at least some degree of selectivity so to adjust thresholds and define conditions for a thermal runaway event based, at least in part, on the characteristics of the load (e.g., wiring and number of LEDs).

A method according to aspects of the present invention generally comprises recognizing a thermal runaway event, sending a signal to a controller which instructs a driver to reduce (or remove) power provided to a load (e.g., an array of LEDs in series), and generating a second signal to instruct the driver to reestablish power provided to said load when (i) the thermal runaway event has been resolved and (ii) there is little to no risk of an inrush of excess voltage or current to the load.

An apparatus according to aspects of the present invention generally comprises an overtemp circuit including a temperature sensing circuit, a current sensing circuit, a voltage sensing circuit, and a processor. Said processor is adapted to provide instruction to a driver (with associated controller) in response to sensed temperature and current values using sensed voltage as guidance in determining driver characteristics prior to providing instruction. The sensed voltage provides, in essence, a feedback loop thereby ensuring that with proper thresholds in place, said apparatus only permits power to be reestablished when (i) the thermal runaway event has been resolved and (ii) there is little to no risk of an inrush of excess voltage or current to the load.

These and other objects, features, advantages, or aspects of the present invention will become more apparent with reference to the accompanying specification and claims.

III. BRIEF DESCRIPTION OF THE DRAWINGS

From time-to-time in this description reference will be taken to the drawings which are identified by figure number and are summarized below.

IV. DETAILED DESCRIPTION OF EXEMPLARY EMBODIMENTS

A. Overview

Figure 1:
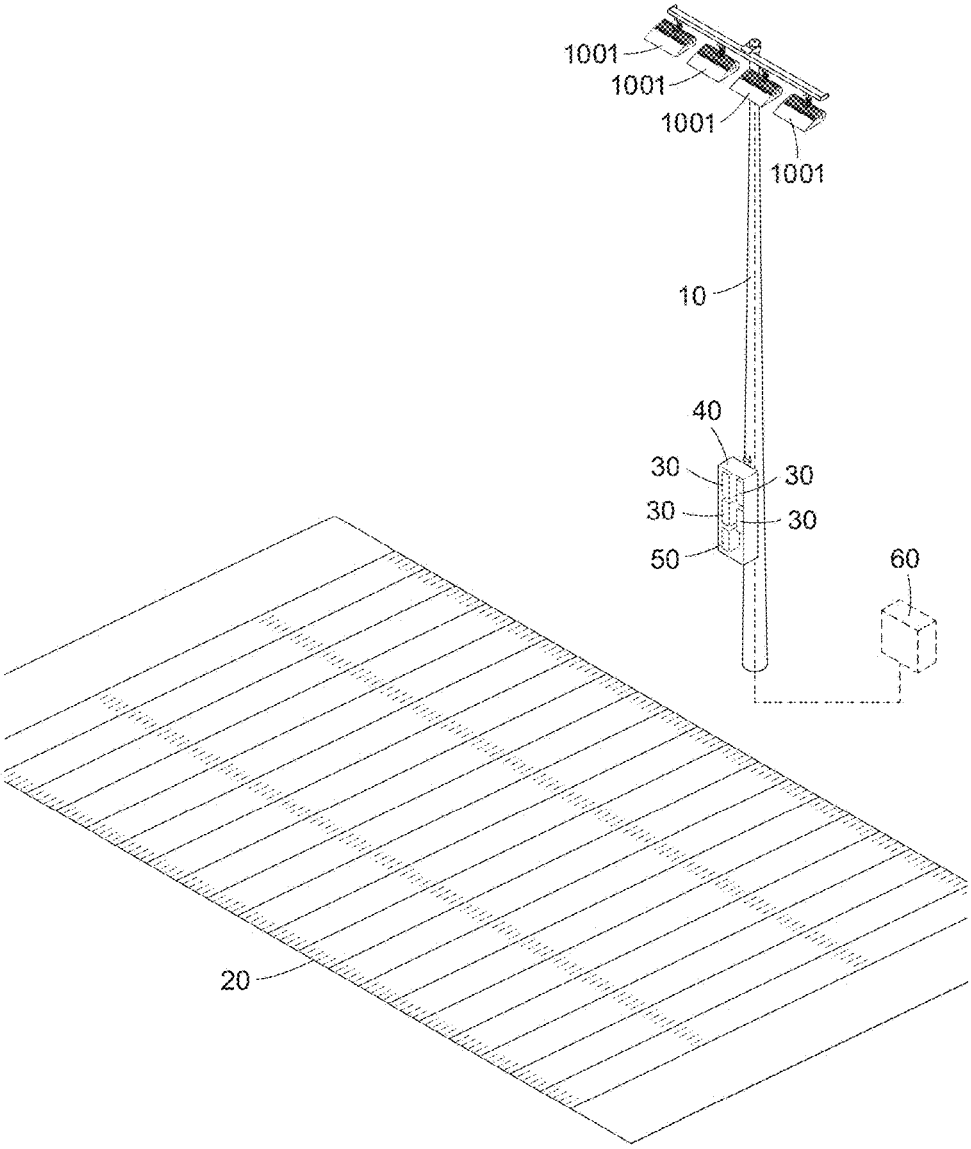
Fig 1 (prior art)
FIG. 1 illustrates a typical prior art sports lighting application including generic LED lighting fixtures.

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same parts throughout the drawings. Likewise, frequent mention will be made to various components and circuits. Reference numbers will be used to indicate certain portions of circuits. For simplicity, all circuit portions are referred to herein as "circuits", regardless of whether said referenced portion comprises a complete circuit in and of itself. Further, reference is made herein to "user(s)", "designers", and/or "operators". It is to be understood that these terms are used for convenience, and in no way place limitations on who may practice the invention, or benefit from aspects thereof. Further, it should be noted that the terms "luminaire", "fixture", and/or "lighting fixture" are used interchangeably herein; these terms are used for convenience, and in no way place limitations on load characteristics, circuit design, or other aspects of the present invention. Lastly, communications between electrical components are referred to herein as "pulses", "communications", "signals", and/or "instructions". It is be understood that communications could take a variety of forms and that the aforementioned terms—used interchangeably for convenience—in no way limits the invention to a particular communication mode, bandwidth, or the like.

The exemplary embodiments envision an overtemp circuit formed from solid state components designed to disable or reduce power to a load when a threshold indicative of a thermal runaway event is exceeded, or in some cases approached, and then reestablish power at a desired level after the thermal runaway event has been resolved (and/or when temperature is below some threshold and the driver has been cycled). As envisioned, the overtemp circuit is formed from components which permit selectivity of the threshold based, at least in part, on characteristics of the load. In practice, the overtemp circuit could be applied to a number of electrical systems and many different kinds of loads; though the following discusses an LED lighting system, the present invention is not limited to such.

FIG. 1 illustrates a generic LED lighting system in which a pole 10 elevates one or more LED lighting fixtures 1001, said fixtures oriented and aimed so to project light generally towards a target area 20 (e.g., a sports field); lighting fixtures could be designed in accordance with U.S. Pat. No. 8,789,967, or otherwise. Generally, power to the LEDs (i.e., the load) is supplied along power wiring from a distribution source 60 at some voltage and amperage regulated by national, state, or local codes (e.g., 480 VAC, 60 Hz). Said codes may also require equipment grounding, distribution panels, a main power disconnect, or the like; for brevity, no such functionality is illustrated. Power wiring generally enters hollow pole 10, then enclosure 40—where it is regulated by some combination of controllers 50 and drivers 30 (here, one driver per fixture, though this is by way of example and not by way of limitation)—before continuing along pole 10 to said fixtures 1001.

Power from a distribution source 60 is often ill-suited for direct application to a load. Incoming power may be three-phase alternating current (AC) whereas an LED requires direct current (DC). The forward voltage drop across an LED (e.g., any of the XLamp series of LEDs available from Cree, Inc., North Carolina, USA) may only be on the order of 3V, but in large number (e.g., as may be required in the example of FIG. 1) may greatly exceed incoming power. Considerations such as these dictate the type and number of drivers. Likewise, in a typical lighting system such as that illustrated in FIG. 1 there may be a need to alter duty cycle (e.g., to manage temperature), adjust current (e.g., in response to some sensor input), or a modification to some other aspect of operation to effectuate a lighting change (e.g., provide dimming). Considerations such as these dictate the type and number of controllers. While a particular combination of controller and driver may be such as is described in U.S. Provisional Patent Application Ser. No. 62/040,741 incorporated by reference herein in its entirety, it is to be understood that it is impractical to discuss every configuration of power control in LED lighting systems, and that a thorough understanding of each is not necessary to practice the invention.

Specialty lighting systems such as the sports lighting system of FIG. 1 typically rely on several hundreds of LEDs so to provide adequate illumination of a target area to one or more standards; often this requires running one or more long strings of LEDs in series for each associated driver (e.g., so to ensure all light sources within a single luminaire act in unison and emit uniformly). To accommodate a long string of series-connected LEDs (e.g., several hundreds with a forward voltage drop on the order of 3V each) given distribution power at 480V, 277V, or even 208V (depending on the geographic area, local codes, and the like), a boost-type driver is needed. It is assumed one of ordinary skill in the art of circuit design, and more specifically LED lighting circuit design and/or power supply design, is well aware of how boost-type converter circuits operate, and so for brevity any discussion of such is omitted.

With respect to the aforementioned boost-type LED drivers, it is well known that when the load (e.g., lighting fixture 1001) is removed from the boost-type driver circuit—as might be the standard protocol for a thermal runaway event—the MOSFET (or similar switching device) associated with the boost-type driver circuit is, in essence, switched off, thereby acting as a current source to an infinite load (an open circuit) until the output voltage reaches a maximum. What may not be well known is that when the load is returned and the circuit closed, there is an inrush of voltage as energy is supplied to the load; this may be harmful to the LEDs (i.e., the load). Initial experiments have shown that for boost-type drivers designed for a maximum 700V output, an inrush voltage of 800V is actually supplied under these conditions—almost instantaneously. Results have shown a best case scenario to be a disabling bright flash of light and a worst case scenario to be a damaging of parts (e.g., the LEDs themselves).

Presented herein are apparatus, methods, and means for dissipating the excess charge that stores in an LED boost-type driver when the circuit is opened in response to a thermal runaway or overcurrent event; according to one example, by dimming down to 0% (i.e., reducing driver output to 0V or near 0V). Also presented herein are apparatus, methods, and means for closing the circuit and reestablishing power to the load once both (i) the thermal runaway or overcurrent event has been resolved and (ii) driver output will not damage the LEDs or other components of the lighting system. This is achieved, in one example, by a combination of sensing circuits, logic, and pulse generator. Communications between the drivers and controller at the base of the pole (see, e.g., reference nos. 30 and 50 of FIG. 1, respectively) and envisioned overtemp circuit components at the top of the pole rely, in one example, upon a combination of existing power wiring and the residual potential in the driver at 0% dimming; this ensures no extra wiring is needed to add the self-healing overtemp functionality to the lighting system, though of course, this is by way of example and not by way of limitation.

A more specific exemplary embodiment, utilizing aspects of the generalized example described above, will now be described.

B. Exemplary Method and Apparatus Embodiment 1

Figure 2:
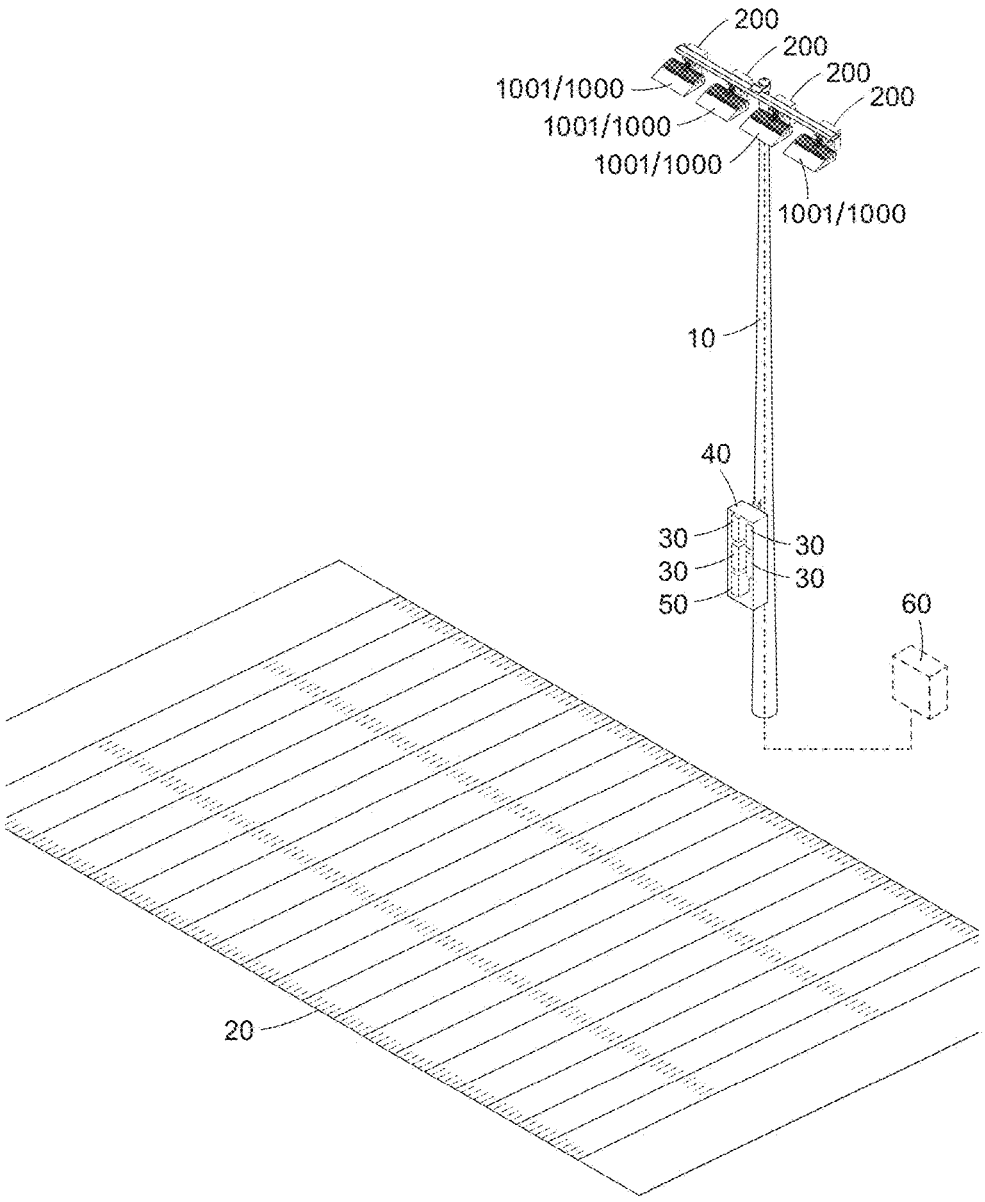
FIG. 2 illustrates the generic lighting system of FIG. 1 modified according to at least some aspects of the present invention.

FIG. 2 illustrates the sports lighting system of FIG. 1 modified according to aspects of the present invention. As can be seen, the lighting system includes some kind of active (or passive) cooling—in this example, fans 200 which are indicated generically by blocks—located proximate the temperature-sensitive components of the lighting system (e.g., the LEDs). Active cooling could be powered from a battery or line power, could be in accordance with the aforementioned incorporated references (or otherwise), or could even cool other components of the lighting system (e.g., drivers); the exact configuration may vary as is needed for the thermal management demands of the load. Most pertinent to the present invention is simply that a failure or absence of cooling means will cause an undesirable rise in temperature of one or more components of the system (at least under some operating conditions).

FIG. 2 also illustrates an exemplary self-healing overtemp circuit 1000, details of which are illustrated in FIGS. 4-10. As is illustrated in the figures, according to the present embodiment circuit 1000 is installed in the fixture itself; as envisioned, on the same board as the LEDs contained within the fixture. While this does permit highly accurate readings from temperature sensing circuit 1005 which can be used to determine LED junction temperature, it is to be understood some or all of the functionality of self-healing overtemp circuit 1000 could be installed elsewhere in the lighting system; additional options are later discussed.

Figure 3:
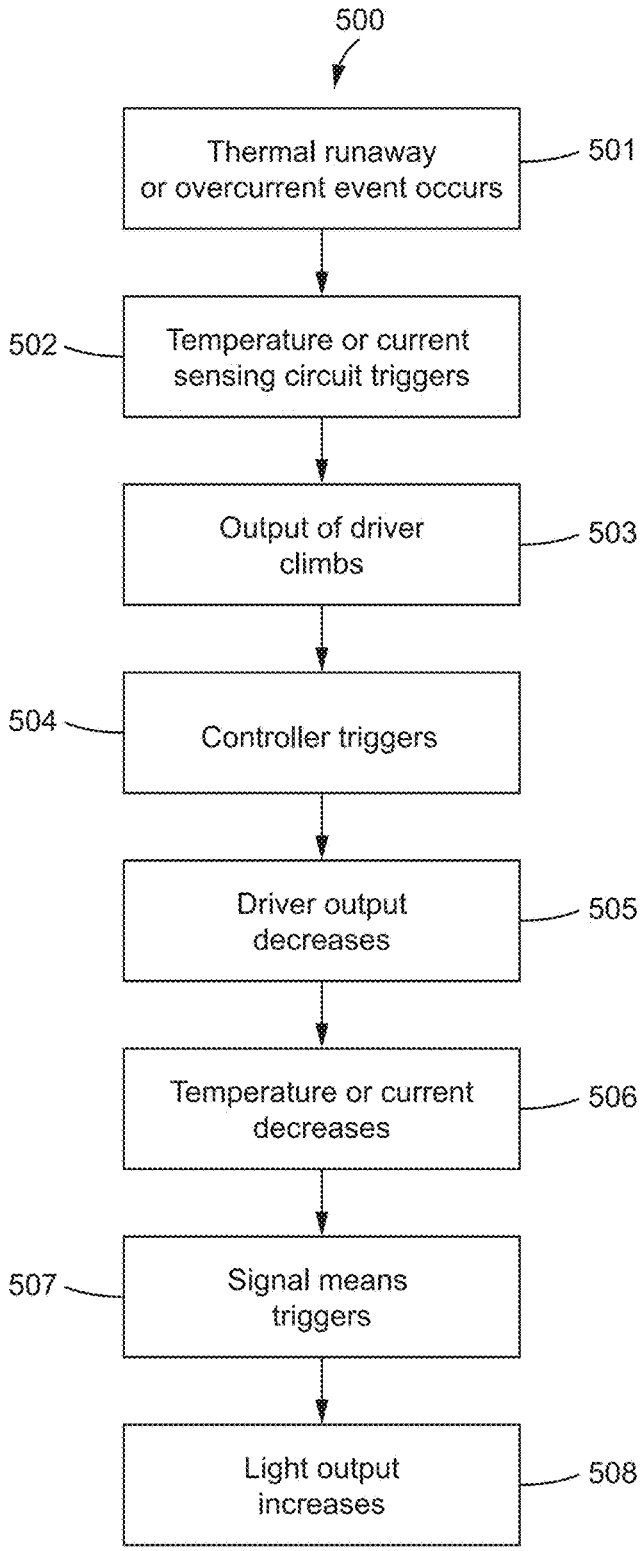
FIG. 3 illustrates one possible method of practicing the invention according to a first embodiment.

FIG. 3 illustrates one possible method of practicing the invention with respect to FIG. 2. According to method 500, a thermal runaway event occurs (step 501); overcurrent conditions are later discussed. Step 501 could comprise a failure of passive or active cooling component 200, some kind of weather event, structural failure of one or more components of the lighting system—any number of events or conditions which causes an undesirable temperature increase in the LEDs or other temperature-sensitive parts of the lighting system. A temperature sensing circuit detects an increase in value and in response to approaching or exceeding some limit a controller circuit sends a signal to a switching circuit to open the lighting circuit (step 502). In response to opening the lighting circuit there is a corresponding rise in the voltage output of the driver (step 503). A voltage sensing circuit detects the increase in voltage and in response to approaching or exceeding some limit, a communication circuit sends a signal to the driver to dim down to 0% (step 504). The output of the driver decreases (step 505). At some point the temperature of the system will decrease (step 506). It is preferred if a decrease in measured temperature is the result of the thermal runaway event being resolved, though the invention is not limited to such. Once both the temperature (as indicated by the aforementioned temperature sensing circuit) and the output voltage of the driver (as indicated by a high voltage temperature sensing circuit at the fixture) are below defined thresholds, the controller circuit sends a signal to the switching circuit to close the circuit (step 507). Simultaneously, or after the circuit is closed, the communication circuit sends a signal to the driver to re-establish power to the load. Power is reestablished by sending an instruction to the LED driver to increase dimming to some level (e.g., to 100%, to the dimming level set just before the thermal runaway event), which causes a commensurate increase in light output of the LEDs (step 508). It is of note that only some LED drivers are adapted to receive such instruction directly, whereas other designs of driver may require an associated controller.

Specific details and functionality of self-healing overtemp circuit 1000 is illustrated in FIGS. 4-10. As envisioned, circuit 1000 is formed from solid state, non-terminal event components; this ensures a robust design which requires little to no intervention from a user. Further, and as will be discussed, a number of components of circuit 1000 are selectable either in terms of quantity or value. This selectivity permits a designer significant flexibility in developing the various thresholds and triggers mentioned above in the description of method 500. Additional features and options are later discussed.

Figure 4:
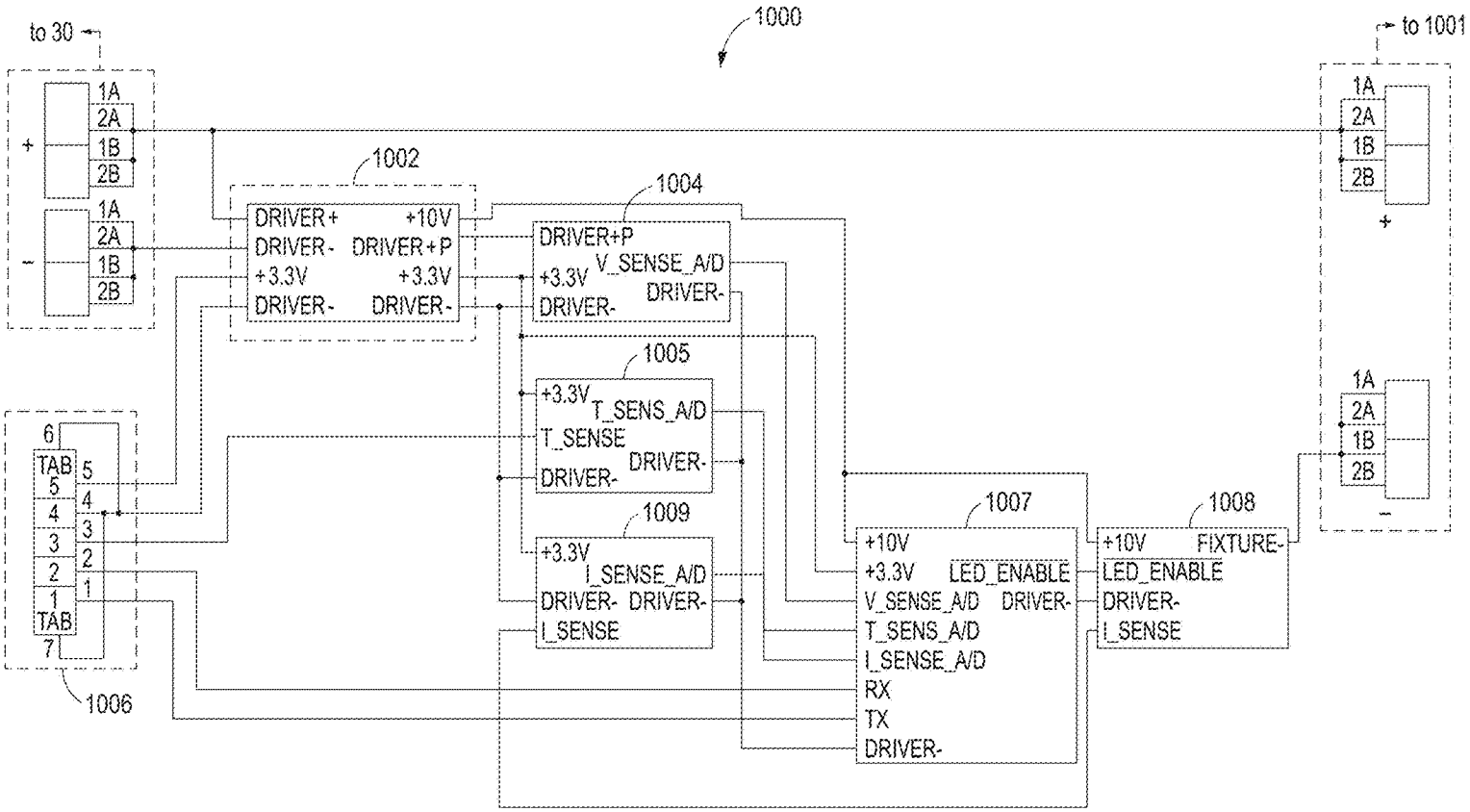
FIG. 4 illustrates, in wiring diagram form, a self-healing overtemp circuit for use in a lighting system such as that illustrated in FIG. 2 in accordance with a method such as that illustrated in FIG. 3. Electrical symbols denoting resistors having 0Ω illustrates jumpers for single-sided boards and electrical symbols denoting "TP" illustrate test points used in troubleshooting.

FIG. 4 illustrates (in wiring diagram form) self-healing overtemp circuit 1000. As envisioned, overtemp circuit 1000 is installed in fixture 1001—preferably on the same board as the LEDs to ensure more accurate temperature readings—though as will be discussed, the invention is not limited to such. After a thermal runaway event has occurred (step 501, FIG. 3) the temperature of the LEDs is expected to rise. This temperature rise is detected by a temperature sensing circuit 1005, shown in detail in FIG. 7. As can be seen from FIG. 7, temperature sensing circuit 1005 generally comprises an analog temperature sensor, amplifiers, and a number of standard capacitors and resistors. In practice, different configurations of lighting fixtures (i.e., loads) are thermally cycled and three values measured: temperatures at the LED solder point, temperature at the board where temperature sensing circuit 1005 resides, and input voltage. Knowing the solder point temperature, input voltage, and LED characteristics such as thermal resistance (commonly available from the LED manufacturer) one can readily calculate junction temperature of the LEDs using well known formulas. In this manner, a temperature at temperature sensing circuit 1005 (i.e., at the temperature sensor) is correlated to an LED junction temperature. Operationally, a lighting designer can select a high temperature reading which correlates to a high junction temperature to use as a trigger for opening the circuit, and a low temperature reading which correlates to a low junction temperature to use as a trigger for closing the circuit.

Figure 10:
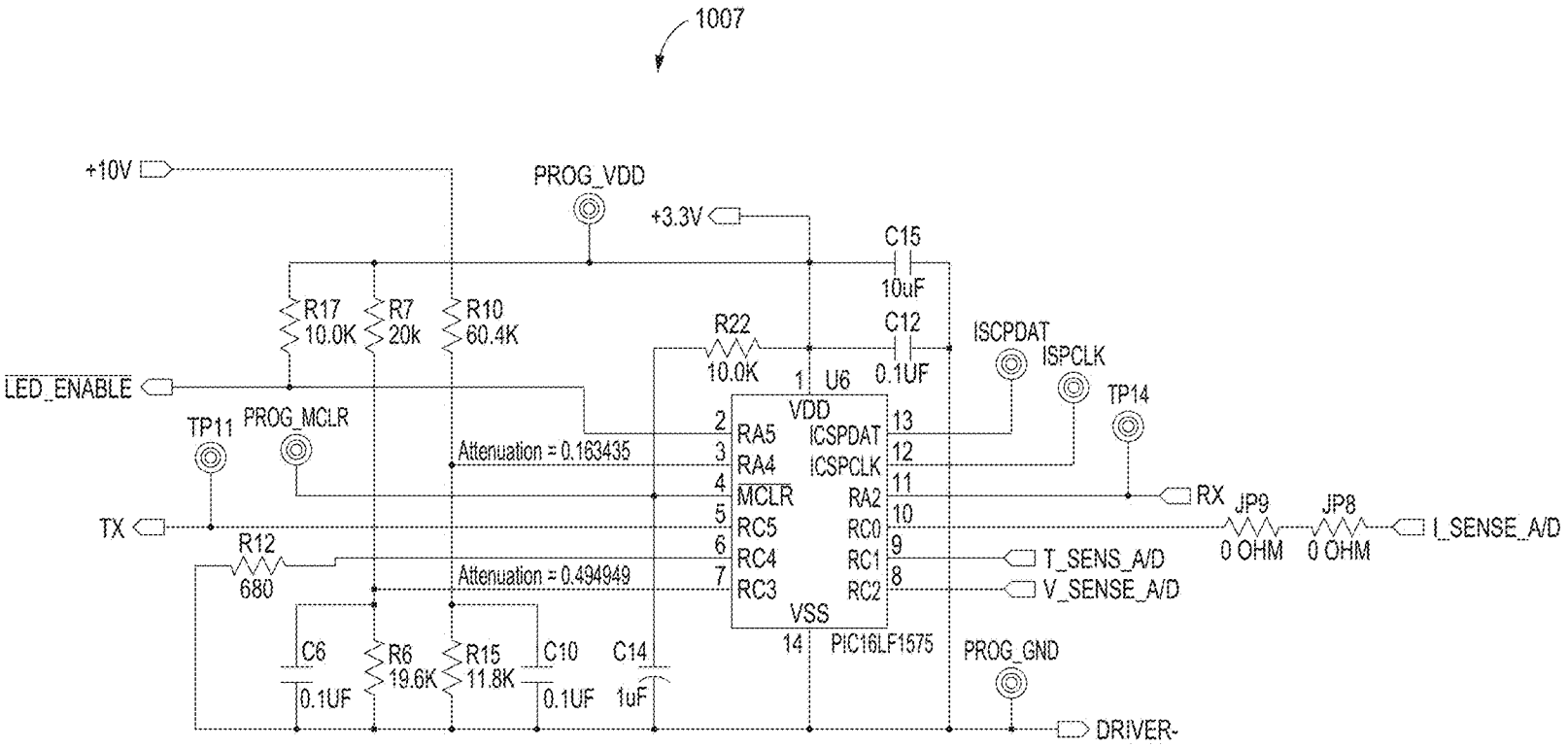
FIG. 10 illustrates the controller circuit of the self-healing overtemp circuit according to a first embodiment.

Temperature readings from temperature sensing circuit 1005 are fed to controller circuit 1007 of FIG. 10. As can be seen from FIG. 10, controller circuit 1007 generally comprises a microprocessor and a number of standard capacitors and resistors. Controller circuit 1007 acts as the hub of self-healing overtemp circuit 1000—as can be ascertained from the number of inputs and outputs illustrated. Controller circuit 1007, and components of overtemp circuit 1000 on the whole, is powered by a power circuit 1002 (see FIG. 5). As can be seen from FIG. 5, power circuit 1002 comprises a depletion mode MOSFET, amplifier, transistor, fast switching diode, and a number of standard capacitors and resistors. Additional power supply options are later discussed.

Figure 9:
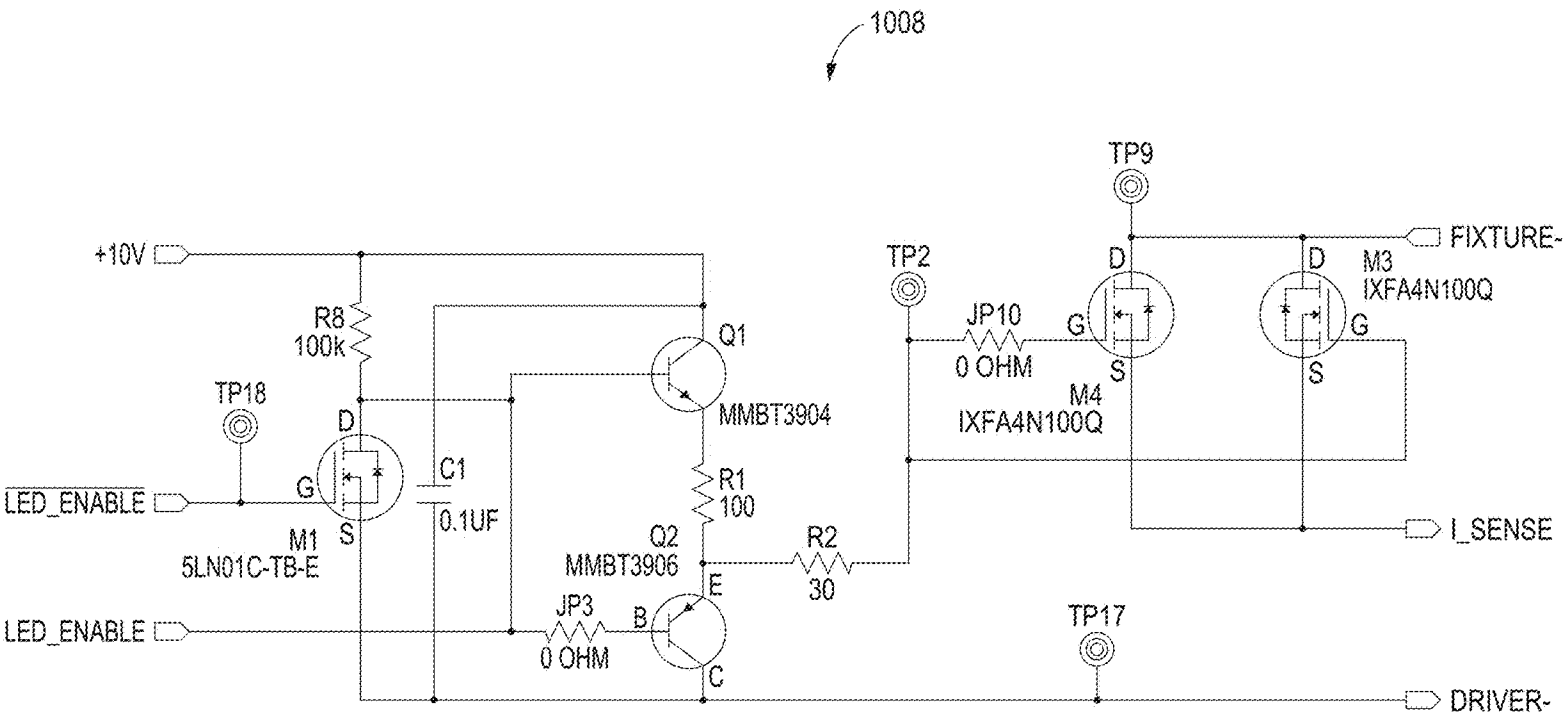
FIG. 9 illustrates the switching circuit of the self-healing overtemp circuit according to a first embodiment.

When temperature readings from temperature sensing circuit 1005 correlate to a thermal runaway condition (i.e., a high junction temperature) as determined by the settings of controller circuit 1007, controller circuit 1007 sends a signal to switching circuit 1008 of FIG. 9 which, in turn, opens the circuit (step 502, FIG. 3). In practice, a temperature reading of 50° C. at the temperature sensor of circuit 1005 might correlate to an LED junction temperature of 80° C. for a particular design of lighting fixture, and may necessitate circuit 1007 sending a control signal to circuit 1008 to open the circuit. As can be seen from FIG. 9, switching circuit 1008 generally comprises a number of MOSFETs (some in enhancement mode), transistors, and a number of standard capacitors and resistors.

Once the circuit is open due to the thermal runaway event, voltage output of the boost-type LED driver climbs (step 503, FIG. 3). Voltage increase is measured by voltage sensing circuit 1004 of FIG. 6. As can be seen from FIG. 6, circuit 1004 generally comprises an amplifier and a number of standard capacitors and resistors. In practice, voltage sensing circuit 1004 is different than temperature sensing circuit 1005 insomuch that the signal is already existing and does not need to be generated (i.e., the output of the driver already exists), requiring only conditioning (see e.g., the string of resistors in FIG. 6); but voltage sensing circuit 1004 is the same as temperature sensing circuit 1005 insomuch that the input provided to controller circuit 1007 triggers an instruction based, at least in part, on characteristics of the load. For example, for some loads a voltage input into controller circuit 1007 correlating to 50V may indicate a deleterious condition, but if the load is different (e.g., number of LEDs in a series-connect string are varied), that same 50V may no longer indicate a deleterious condition.

When voltage readings from voltage sensing circuit 1004 correlate to an excessively high driver output voltage due to open circuit as determined by the settings of controller circuit 1007, controller circuit 1007 sends a communication to the driver to dim to 0% (step 504, FIG. 3). This communication can be sent wirelessly; communication circuit 1006 (FIG. 4) could be completed by mating to a wireless controller board (e.g., Bluetooth Low Energy (BLE) board) at the top of the pole (possibly in the lighting fixture) which could send the communication wirelessly to a complementary Wi-Fi controller board at the driver (or controller for the driver) at the bottom of the pole. This wireless option may be preferable in situations where wireless communications are permitted and cost is not the prevailing concern; two other signal/communication options are later discussed.

In practice, LED driver output voltage will likely decrease to below some threshold—which is defined by controller circuit 1007 (FIG. 10)—before the temperature of the LED fixture decreases below the temperature threshold defined by controller circuit 1007; this is indicated by steps 505 and 506 of method 500, respectively. Again, thresholds may be varied by a designer in accordance with preferences, characteristics of the load, or otherwise. Further, because upper and lower thresholds are defined at controller circuit 1007, the circuit is self healing; self-healing in the sense that no intervention from an operator is required to reestablish power to the lighting circuit after a fault related to temperature or voltage (step 507, FIG. 3). That being said, as previously discussed, certain types of drivers (e.g., boost-type drivers) are prone to supplying an inrush voltage far exceeding what is safe and/or required for a load when power is reestablished under the conditions described. Therefore, as part of ramping light back up (step 508, FIG. 3) power may need to first be cycled. This could happen automatically or semi-automatically (e.g., implemented as part of standard driver controller protocol) depending on the type of driver and associated controller. Also, as will be discussed, the nature of the communications means may impact how power is cycled pursuant to step 508.

1. Power Supply Options

Figure 5:
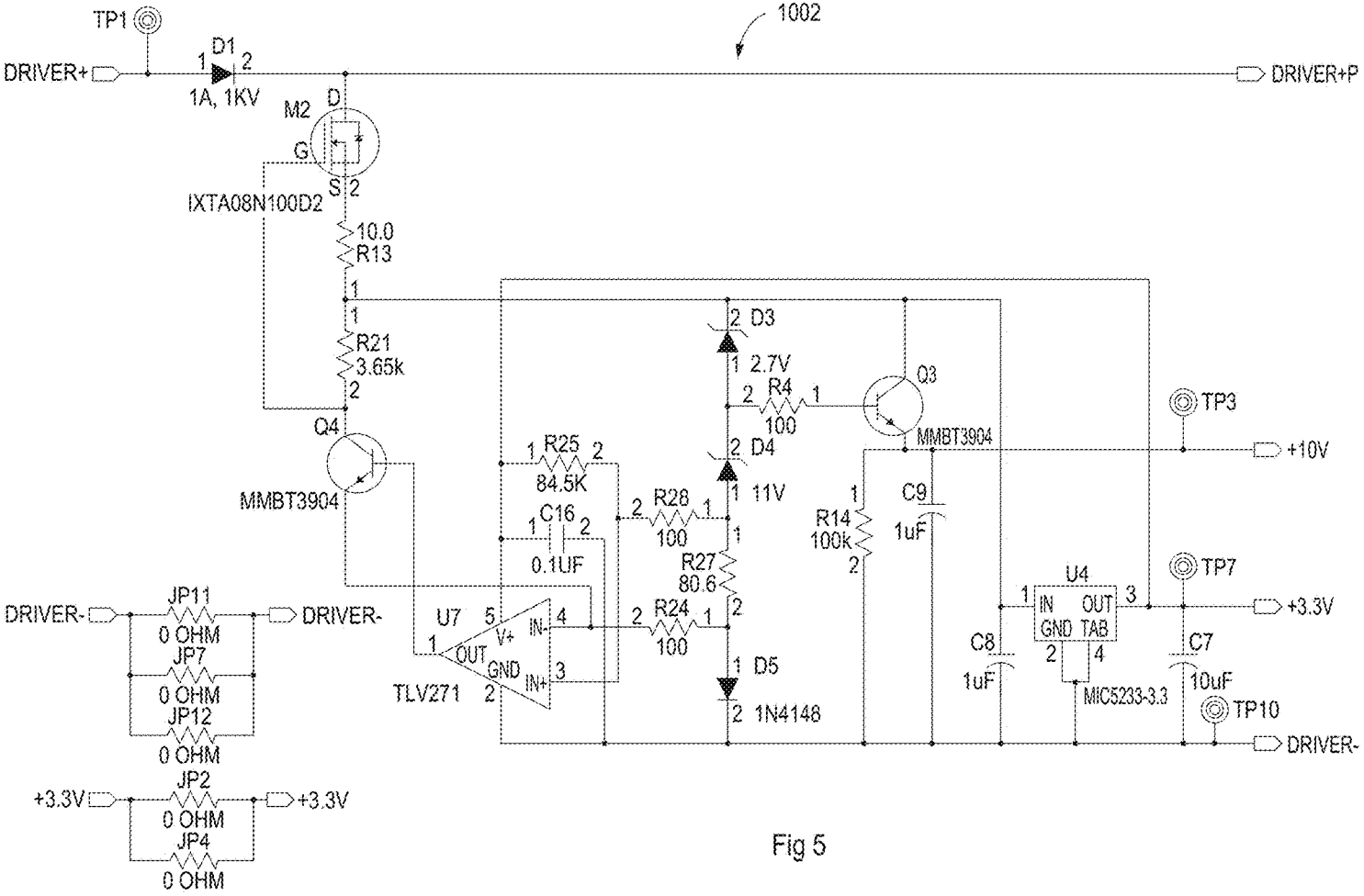
FIG. 5 illustrates the power supply circuit for the self-healing overtemp circuit according to a first embodiment.
Figure 6:
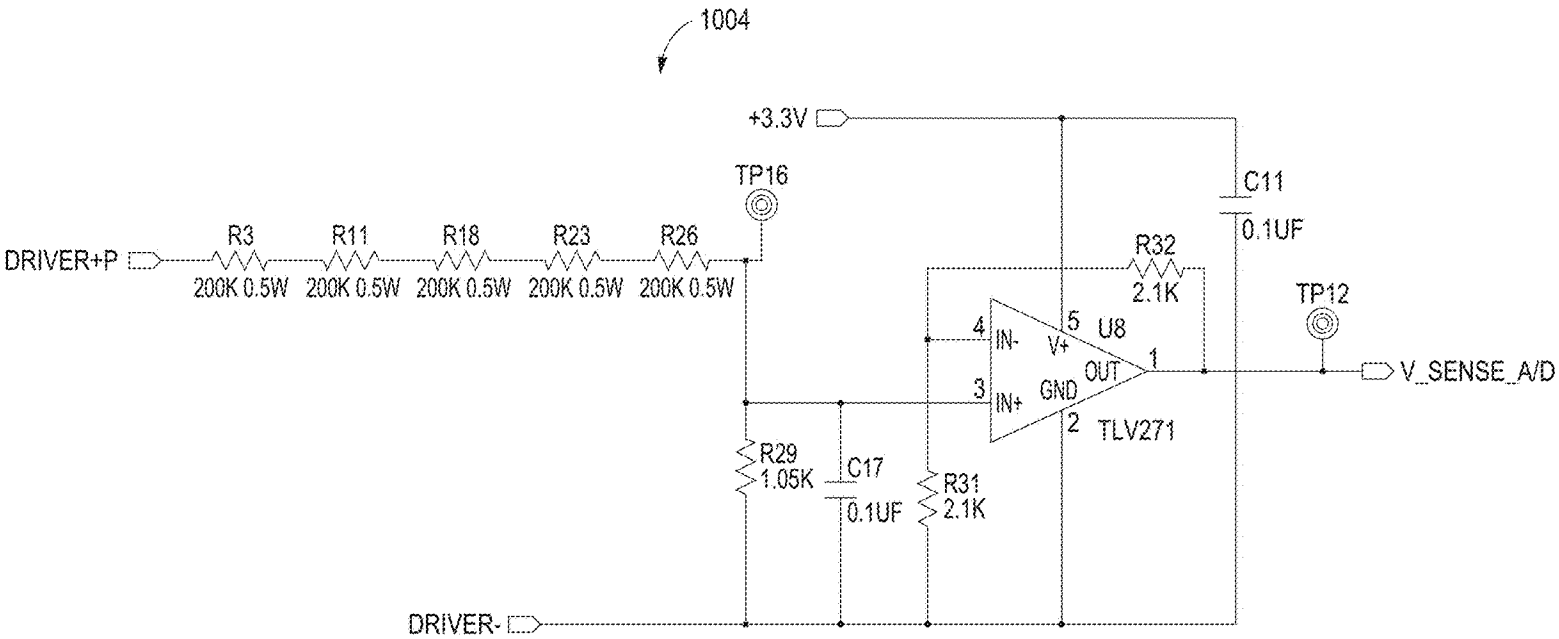
FIG. 6 illustrates the voltage sensing circuit of the self-healing overtemp circuit according to a first embodiment.
Figure 7:
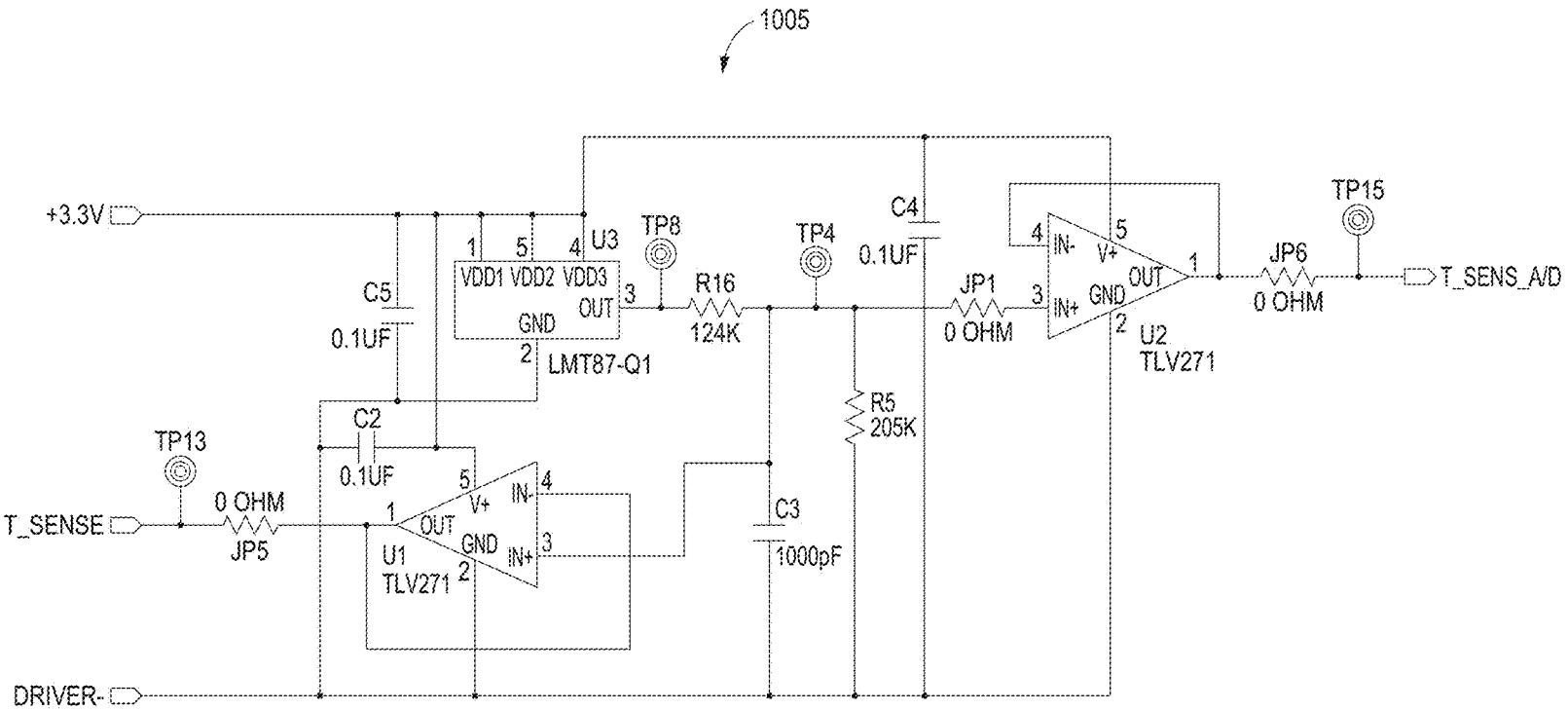
FIG. 7 illustrates the temperature sensing circuit of the self-healing overtemp circuit according to a first embodiment.
Figure 8:
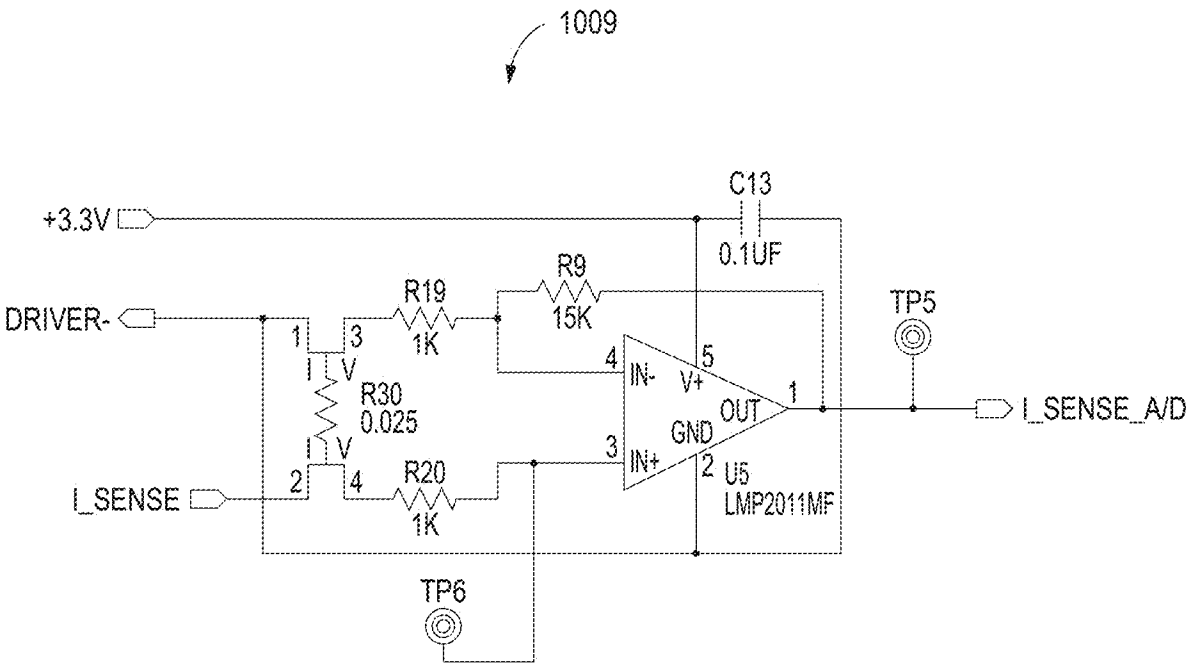
FIG. 8 illustrates the current sensing circuit of the self-healing overtemp circuit according to a first embodiment.

As previously stated, power for self-healing overtemp circuit 1000 is provided by power supply circuit 1002 of FIG. 5. Other power supply options are possible, and envisioned. For example, power for self-healing overtemp circuit 1000 may be pulled from line voltage; this eliminates the need for additional wiring in the interior of pole 10 (FIGS. 1 and 2). The interior space of a lighting pole is typically already filled with wires, wire harnesses, and the like—which may impact an airflow path for some active cooling techniques—and so minimizing the impact to the already crowded space within the interior of such a pole may yield multiple benefits. Of course, line voltage (e.g., 700-800 VDC post-driver on its way to the top of the pole) is ill-suited to the components of self-healing overtemp circuit 1000, and so some conditioning may be required.

As a further alternative, power for self-healing overtemp circuit 1000 could be provided by a battery system; such a system might be similar to that in U.S. Pat. No. 8,946,991, or otherwise.

2. Signal/Communication Options

As previously stated, communication from controller circuit 1007 of FIG. 10 so to facilitate method 500 of FIG. 3 is wireless; i.e., communicated to communication circuit 1006 (FIG. 4) which is operationally connected to a commercially available wireless controller (not illustrated), which communicates wirelessly with a complementary wireless controller (not illustrated) at the bottom of the pole. Another option is to use existing power wiring as the communications means.

A wired configuration relying on powerline communications would require a nominal potential at the driver to carry a signal; therefore step 505 of FIG. 3 would be modified insomuch that the driver would not dim to 0% but to some higher percentage that was still below the excitation voltage of the LEDs (e.g., 1-5%). With a signal path in place, controller circuit 1007 could provide communication directly to the driver or controller associated with the driver along existing wiring. If the microprocessor of controller circuit 1007 did not have capability to send such a communication pulse, controller circuit 1007 could be modified to include a pulse generator circuit (e.g., including a 555 timer IC).

Alternatively, self-healing overtemp circuit 1000 could exist as a standalone option; namely, with no communication means to reestablish power to the driver. In such a scenario a user would likely ascertain when a lighting fixture had likely cooled, and could manually flip a circuit breaker to reset the AC input to the driver (i.e., cycle power to the driver). The standalone option would not permit a slow ramp-down of light—the driver would immediately go to 0%—but a standalone version might be preferential for situations where an overcurrent condition is suspected, as it requires a manual override from a user who, presumably, would be equipped to troubleshoot driver failures. Alternatively, if self-healing overtemp circuit 1000 is in operative communication with remote control means for the lighting system, the remote control means may be used to cycle power. One possible example of remote control means having functionality for cycling power upon input from self-healing overtemp circuit 1000 may be as is described in U.S. Pat. No. 7,209,958 incorporated by reference herein in its entirety.

Overcurrent Protection

Overcurrent is a situation where excessive current is provided to the load. In traditional electrical systems, an overcurrent condition is associated with a grounding fault or a short in the circuit. In the specialty LED lighting system of FIGS. 1 and 2, though, an overcurrent condition can be associated with failure of a particular component within the aforementioned driver. An overcurrent condition can arise when said component—an optocoupler—fails and the driver no longer has an accurate reading of output current. Results have shown that left unchecked, output current goes to the maximum rated for the driver, which in turn increases heat and damages parts (particularly the LEDs). If desired, self-healing overtemp circuit 1000 could include a current sensing circuit such that method 500 of FIG. 3 could also detect an overcurrent condition. As can be seen from FIG. 8, current sensing circuit 1009 generally comprises a current sensing resistor, amplifier, and a number of standard capacitors and resistors. In practice, current sensing circuit 1009 is similar to voltage sensing circuit 1004 insomuch that the signal is already existing and does not need to be generated (i.e., the output of the driver already exists), requiring only conditioning; and similar insomuch that that the input provided to controller circuit 1007 triggers an instruction based, at least in part, on characteristics of the load. In practice, method 500 would proceed similarly, but taking into account the additional current input to controller circuit 1007.

C. Options and Alternatives

The invention may take many forms and embodiments. The foregoing examples are but a few of those. To give some sense of some options and alternatives, a few examples are given below.

Exemplary embodiments have addressed electrical circuits in terms of a load comprising LEDs, a thermal runaway event indicative of failure of active or passing cooling, an overcurrent condition indicative of failure of a driver component, and triggering circuits based on (i) output voltage of a boost-type LED driver, (ii) output current of said driver, and (iii) LED temperature. It is to be understood that there are a number of options and alternatives that could be explored without departing from at least some aspects according to the present invention. For example, while there is a benefit to measuring temperature of the LEDs—since efficacy is so closely tied to junction temperature in LEDs—temperature could be measured with respect to other parts of the system (e.g., the driver or controller). Temperature sensing circuit 1005 could be installed anywhere, regardless of whether LED temperature or some other temperature was being measured. This is likewise true for voltage measurements. If a different power supply was used which exhibited different characteristics but still resulted in an undesirable effect, voltage may no longer be a relevant or convenient triggering metric. For example, assume a driver (if overheated) no longer provides a predictable dimming profile (i.e., a command from the controller no longer produces an expected output to the load). Fluctuations in output voltage may render the metric unreliable and so a self-healing overtemp circuit such as that described herein could rely upon photocell input for method 500. This approach could be extended to non-catastrophic or terminal events such as the thermal runaway or overcurrent events previously described. For example, aspects according to the present invention could be applied to normal driver operation so to effectuate normal dimming profiles (e.g., to run LEDs at a lower output when photocells indicate an abundance of ambient light, to extend LED life by running LEDs at a lower output when they (for any reason) are "running too hot").

As a few additional examples of options and alternatives to those already described herein, the load could comprise other light sources (e.g., HID light sources) or non-light source loads; one possible example being a flow control system wherein a thermal runaway event results in an undesirable change in pressure or viscosity of a substance. Multiple temperature or voltage thresholds could be developed: to permit some low level light output once LEDs have cooled some (but before the thermal runaway is resolved), to permit a ramping down of light to make the change less abrupt, to more proactively identify an impending thermal runaway or overcurrent event and provide preemptive power reduction, etc.

What is claimed is:

1. A method of reestablishing power to an electrical load in an electrical systemafter a thermal runaway event comprising:

a. detecting the thermal runaway event;
b. removing power to the electrical load;
c. sensing temperature and at least one other output of a component of the electrical system;
d. reestablishing power to the electrical load in a controlled fashion after both the sensed temperature and the at least one other output are below predefined thresholds.

2. The method of claim 1 wherein the removing power to the electrical load comprises opening a circuit of the electrical system.

3. The method of claim 2 wherein the electrical load comprises a plurality of LEDs connected in series, and wherein the component comprises a boost-type LED driver.

4. The method of claim 3 wherein the at least one other output of the electrical system comprises the output voltage of the boost-type LED driver.

5. The method of claim 4 further comprising an LED controller and wherein the step of reestablishing power to the plurality of LEDs comprises communicating an instruction from the LED controller to the boost-type LED driver to increase output voltage.

6. The method of claim 1 further wherein the at least one other output of a component of the electrical system comprises output current.

7. An overtemp protection circuit for an LED lighting system driven at high voltages by one or more LED drivers comprising:

a. a thermal runaway sub-circuit for deriving junction temperature of at least some of the LEDs;
b. a switching sub-circuit for removing or reducing electrical power from the drivers to the LEDs;
c. a voltage sensing sub-circuit for sensing voltage to the LEDs;
d. a current sensing sub-circuit for sensing current to the LEDs;
e. a programmable controller operably connected to the thermal runaway, switching, voltage sensing, and current sensing sub-circuits, the controller:
   i. including programmable thresholds indicative of thermal runaway, excess voltage, and excess current elated to the LEDs;
   ii. instructing removal or reduction of power from the drivers to the LEDs upon detecting LED junction temperature exceeding the thermal runaway threshold;
   iii. instructing reestablishment of at least partial power from the drivers to the LEDs upon:
      1. detecting LED junction temperature returning to under the thermal runaway threshold; and
      2. detecting LED voltage and current under the voltage and current thresholds;
f. so that both power reduction and reestablishment are controlled with further protection against risk of excess voltage or current on reestablishment of power.

8. The overtemp protection circuit of claim 7 wherein the high voltages are on the order of 1000 V and higher and the drivers are boost-type LED drivers.

9. The overtemp protection circuit of claim 7 wherein the thermal runaway sub-circuit indirectly derives junction temperature of the LEDs from values from:

a. a component that measures temperature at solder points of the LEDs;
b. a component that measures temperature at or related to the thermal runaway sub-circuit; or
c. a component that measures input voltage to the LEDs.

10. The overtemp protection circuit of claim 7 wherein the switching sub-circuit comprises solid state components.

11. The overtemp protection circuit of claim 7 wherein the controller is programmable to set, adjust, or change the thresholds based at least on characteristics of the LEDs and power connections to the LEDs and to selectively instruct cycling of one or more drivers prior to reestablishment of power to the LEDs.

12. The overtemp protection circuit of claim 7 further comprising a wireless communications sub-circuit for communicating between the controller and one or more of the sub-circuits.

13. The overtemp protection circuit of claim 7 further comprising an overcurrent sensing sub-circuit operably connected to and sensing an overcurrent condition related to one or more of the drivers.

14. The overtemp protection circuit of claim 7 in combination with the LED lighting system and LED drivers.

15. The combination of claim 14 installed on a plurality of elevating poles or structures at a sports field.

16. The combination of claim 14 further comprising at least one of an active or passive cooling system for the LEDs.

* * * * *